US005141190A

United States Patent [19]

Wu

[11] Patent Number: 5,141,190

[45] Date of Patent: Aug. 25, 1992

[54] ADJUSTABLE BASE PAD DEVICE

[76] Inventor: Mu C. Wu, No. 23, Hai Huan Street, Tainan

[21] Appl. No.: 779,839

[22] Filed: Oct. 21, 1991

[51] Int. Cl.[5] ..... A47B 91/02

[52] U.S. Cl. ..... 248/188.4; 248/650

[58] Field of Search ..... 248/188.4, 188.7, 188.9, 248/650, 188.3

[56] References Cited

U.S. PATENT DOCUMENTS 2,024,728 12/1935 Galson ..... 248/188.4 X
3,100,099 8/1983 Schaefer ..... 248/188.4
4,915,334 4/1990 White ..... 248/188.4

FOREIGN PATENT DOCUMENTS 3904755 8/1990 Fed. Rep. of Germany ... 248/188.4

*Primary Examiner*—Alvin C. Chin-Shue

[57] ABSTRACT

A base pad device having a hardened and lapped base pad threaded to a corner of a bottom of a base and an adjustment knob turnably mounted on top of the base, the adjustment knob integral with a socket to non-rotatably receive a rectanglar head of the base pad for a height adjustment operation.

1 Claim, 2 Drawing Sheets

ADJUSTABLE BASE PAD DEVICE

FIELD OF THE INVENTION

This invention relates generally to base pads and more particularly to an adjustable base pad device.

BACKGROUND OF THE INVENTION

In the past, home appliance or indoor devices such as exercise bike uses base pads threaded under the base thereof to allow stable and even location of the device. Home appliance such as furniture may also be provided with adjustable base pads under four or more corners of its base for same purposes. Said base pad has a hardened knob integral with a threaded shaft that is threaded from under side into a screw hole of the base. An adjustment operation may be necessary when the device is placed on an uneven floor or ground. Said device should be cautiously put sideway from time to time so that the base pads under the base thereof can be adjusted sequentially to balance the device. For heavy objects, such an adjustment operation is tedious and time consuming.

SUMMARY OF THE INVENTION

It is accordingly a primary object of the present invention to provide an adjustable base pad device which overcomes the foregoing defects associated with the prior art.

According to the present invention, this and other objects are achieved by providing an improved adjustable base pad device for integrally mounted to a corner of a base of a device, such as an exercise bike, which comprises a frame member having a pair of spaced apart top and bottom walls and a pair of spaced apart side walls defining a transverse internal passage therethrough, a brace member integrally extending from a corner of a base of a device and dimensioned to be received in the transverse internal passage of the frame member, vertically aligned openings formed in the frame member and the brace member, a base pad having a hardened and lapped knob integral with a shaft which is divided into a screw section and a rectangular head, a nut accommodated in the brace member for engaging the screw section of the shaft of the base pad and an adjustment knob having a socket projecting into the openings of the frame member and brace member to non-rotatably receive the rectangular head of the shaft of the base pad so that the base pad can be threaded by the adjustment knob to adjust the height of this base pad device.

DETAILED DESCRIPTION OF THE PREFERRED EMBODIMENT

Figure 1:
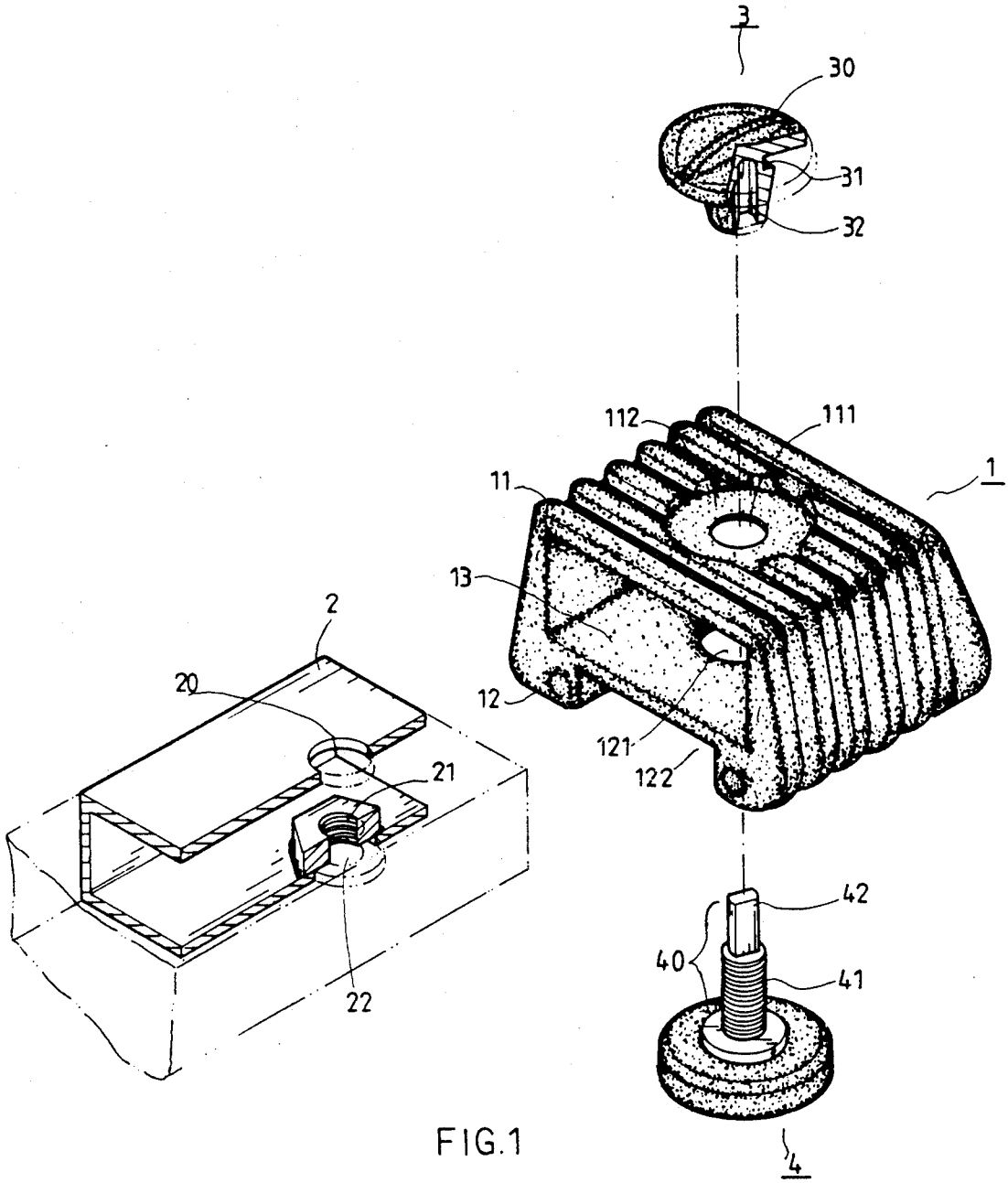
FIG. 1 is an exploded perspective view partially broken away of a preferred embodiment according to the present invention.

Referring to FIG. 1, an improved adjustable pad device according to the present invention comprises a frame member 1 having a pair of spaced apart side walls and a pair of spaced apart top wall 11 and bottom wall 12 which defines a substantially rectangular passage 13 extending transversely therethrough. A tunnel-shaped passage 122 also extending transversely is formed in the central portion of the top wall 11 and a first opening 111 is coaxially formed in the depression 112. A second opening 121 in alignment with the first opening 111 is formed in the bottom wall 12.

A brace member 2 integrally extending from a corner of a base of, such as, an exercise bike is shaped to be fitted in the rectangular passage 13 of the frame member 1. The brace member 2 has a substantially rectangular cross section and is formed with a pair of vertically aligned openings 20, 22 respectively in top and bottom walls thereof. A nut 21 is secured to the inner surface of the bottom wall with its screw hole corresponding the opening 22.

A base pad 4 having a shaft 40 divided into a screw section 41 and rectangular head 42 is adapted to extend through the bottom opening 121 of the frame member 1 and engage the nut 21 with the screw section 41 of the shaft 40 with the rectangular head 42 pointing upward.

An adjustment knob 3 having a ridge 30 on top for turning the knob 3 with adjacent fingers, a socket 32 integrally suspended from the knob 3 with a recess of a rectangular cross section for non-ratatably receiving the rectangular head 42 of the shaft 40 of the base pad 4 and a groove 31 circumferentially formed in a neck portion of the knob 3, is provided for rotating the base pad 4.

Figure 2:
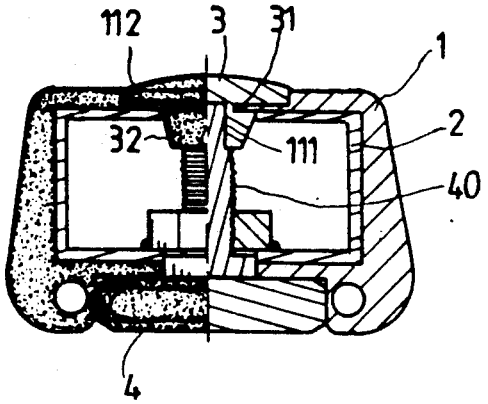
FIG. 2 is a half cross-sectional view of the preferred embodiment in an assembled condition.

Referring to FIG. 2, the depression 112 defines a relatively thin flange portion around the opening 111. The flange portion engages the circumferential groove 31 to retain the adjustment knob 3 in position and allow the knob 3 to rotate with respect to the frame member 1. In assembled condition, the brace member 2 is press-fitted in the frame member 1 and the base pad 4 is journelled in the frame and brace members 1, 2 from underside and the adjustment knob 3 is retained in position by engaging the flange portion in the circumferential groove 31 thereof whereas the rectangular head 42 of the shaft 40 is received by the socket 32 of the adjustment knob 3.

Figure 3:
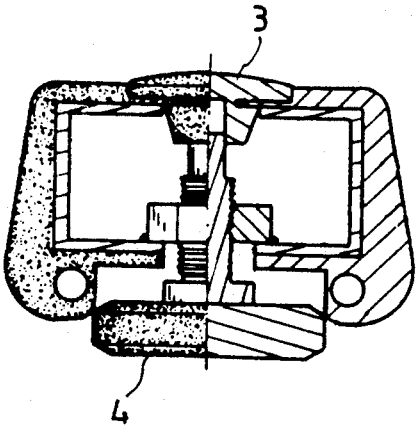
FIG. 3 is a similar view to the embodiment shown in FIG. 2 with the device in a slightly elevated position.

In operation, as best shown in FIG. 3, a device, such as an exercise bike or furniture can be adjusted to a stable or even state after locating on a floor or ground simply by turning the adjustment knob 3 with fingers to regulate the base pad 4. Putting sideway of the device from time to time to elevate one corner after the other for adjusting known base pads is not necessary. An easy operation to stably and evenly locating a device on a floor or ground can thus be achieved.

I claim:

1. An adjustable base pad device comprising:

a frame member having a pair of spaced apart side walls and a pair of spaced apart top wall and bottom wall to define a passageway extending therethrough;

a brace member adapted to be press-fitted in the passageway of the frame member;

a plurality of openings vertically aligned in the top wall and bottom wall of the frame member and brace member;

a depression formed in the top wall of the frame member to define a flange portion around the opening in the top wall of the frame member;

a nut member mounted to the brace member and having a screw hole aligned with the openings;

a screw pad having a shaft formed with a screw adapted to extend through the opening in the bottom wall of the frame member and engage the nut member and a regular polygonal end protruding from the screw hole of the nut member; and a knob integral with a socket extending downwardly through the opening in the top wall of the frame member to non-ratatably receive the regular polygonal end of the shaft of the screw pad and a groove circumferentially formed around a side wall of the knob to rotatably engage the flange portion of the top wall of the frame member.

* * * * *